US008558482B2

(12) United States Patent
Chu

(10) Patent No.: US 8,558,482 B2
(45) Date of Patent: Oct. 15, 2013

(54) PROGRAMMABLE CURRENT PWM DIMMING CONTROLLER

(75) Inventor: Yik Lun Chu, Hong Kong (HK)

(73) Assignee: GRE Alpha Electronics Ltd. Institute Company Limited, Hong Kong Science Park, Shatin, New Territories, Hong Kong (CN)

( * ) Notice: Subject to any disclaimer, the term of this patent is extended or adjusted under 35 U.S.C. 154(b) by 341 days.

(21) Appl. No.: 13/031,633

(22) Filed: Feb. 22, 2011

(65) Prior Publication Data

US 2012/0212151 A1 Aug. 23, 2012

(51) Int. Cl.
*G05F 1/00* (2006.01)

(52) U.S. Cl.
USPC ..... 315/307; 315/308; 315/291; 315/312

(58) Field of Classification Search
USPC ..... 315/88, 91, 93, 185 R, 192, 210, 224, 315/226, 291, 294, 297, 299, 300, 301, 302, 315/307, 308, 311, 312, 318, 361
See application file for complete search history.

(56) References Cited

U.S. PATENT DOCUMENTS

| | | | | |
|---|---|---|---|---|
| 6,359,392 | B1 | 3/2002 | He | |
| 6,586,890 | B2 | 7/2003 | Min et al. | |
| 7,116,294 | B2 | 10/2006 | Stopa | |
| 2007/0097043 | A1 | 5/2007 | Yang | |
| 2008/0018261 | A1 | 1/2008 | Kastner | |
| 2011/0080110 | A1 * | 4/2011 | Nuhfer et al. | 315/291 |

* cited by examiner

*Primary Examiner* — Douglas W Owens
*Assistant Examiner* — Jianzi Chen
(74) *Attorney, Agent, or Firm* — Ella Cheong Hong Kong; Sam T. Yip

(57) ABSTRACT

An integrated system for supplying direct current and brightness dimming for light emitting diodes (LEDs) comprising: an LED driver power supply for supplying a constant direct current; an array of one or more LEDs; and an integrated programmable LED current pulse width modulation (PWM) dimming controller; wherein the integrated programmable LED current pulse width modulation (PWM) dimming controller comprising: a front control panel for controlling the brightness of the array of one or more LEDs; and an LED current PWM dimming module.

3 Claims, 4 Drawing Sheets

PROGRAMMABLE CURRENT PWM DIMMING CONTROLLER

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates generally to light emitting diode (LED) drivers. More specifically, the present invention relates to the brightness dimming control circuitry of LED.

BACKGROUND

Traditionally, incandescent and fluorescent lights have been the primary source of artificial illumination. However, significant advances in the light emitting diode (LED) technology have made the light output of LEDs not only for indicator applications but also sufficient for general illumination.

LEDs are a type of semiconductor device requiring direct current (DC) electricity input source for operation. Conventional LED lighting unit comprises a LED driver power supply, a dimming module, a dimming controller panel, and arrays of LEDs. The LED driver power supply takes an external electricity power input source and convert to a constant direct current output, feeding the dimming module and in turn the LEDs. For land and building use, the external power source is usually an alternative current electricity power source. In such conventional LED lighting unit, one limitation is that the choice of LED driver power supply used must be carefully matched with the capacity of the LEDs, as the maximum current driving the LEDs is fixed by the LED driver power supply based on its type and capacity.

One common type of dimming module is the low frequency Pulse-width Modulator (PWM). The average value of current fed to the load LEDs is controlled by turning a switch between the power input and load on and off at a fast pace. The longer the switch is on compared to the off periods, the higher the current supplied to the load is. Thus, the current supplied to the LEDs is $I_{min} \leq I_{LED} \leq I_{Driver}$, where $I_{LED}$ is the current supplied to the LED; $I_{Driver}$ is the direct current output of the LED driver power supply; and $I_{min}$ is minimum current that the PWM dimming module can output. The switching frequency of this type of PWM dimming module is usually controlled by a separate dimming controller panel. One disadvantage of this arrangement is the complicated wiring and installation. Another disadvantage is the relatively high cost associated with a separate dimming controller panel.

U.S. Patent Application Publication No. 2007/0097043 discloses a LED driver aims to improve the efficiency of LED by adjusting the feeding current in correlation with the LED temperature. In this disclosure, although a control circuit is used to adjust the feeding current to the LED, this control circuit is to maintain a constant chromaticity and/or luminosity of the LED and is not meant to be used to adjust the brightness of the LED.

U.S. Pat. No. 6,586,890 discloses a driver circuit for LEDs using pulse width modulation (PWM). It also uses current feedback to adjust power to the LEDs and provides a full light and a dim mode. The disclosed driver circuit aims to provide good regulation and efficiency while the current feedback is to maintain operation at the LEDs' nominal current. But the disclosed system is not an integrated system providing both a constant D/C and user-adjustable dimming functionality.

SUMMARY

It is an objective of the presently claimed invention to provide an integrated LED driver, dimming, and control system that eliminates complicated wiring and the high cost associating with using separate components for the dimming control panel and the PWM unit.

It is a further objective of the presently claimed invention to provide the feature of a configurable maximum LED feeding current from a constant DC power supply such that LEDs of different types and capacity can be used without the need of matching LED drivers.

In accordance with various embodiments, the presently claimed programmable LED current PWM dimming controller integrates a light dimming control front panel with a PWM dimming module. The integrated light dimming control front panel can be one of the types of light dimming control panel including a mechanical-analog dial type control, a mechanical-analog slider type control, and an electronic-digital type control. Because light dimming control front panel is integrated with the PWM dimming module, only two sets of electrical wires are needed for the LED driver power supply current input connection and LED feeding current output connection.

In accordance with one embodiment, the presently claimed programmable LED current PWM dimming controller includes a trim pot or selector with a constant current DC-DC buck converter for stepping down the maximum LED feeding current, such that different types of LEDs can be driven by the same LED driver power supply; particularly in the case where the LED driver is supplying a constant DC current that is higher than LEDs' rated maximum input current.

In accordance with another embodiment, the presently claimed programmable LED current PWM dimming controller can provide an automatic compliance LED voltage feeding from one LED to a maximum number of LEDs where the aggregate voltage drop is within the range of $V_{in}-2V$, where $V_{in}$ is the feeding voltage to the one or more LEDs that are connected in series.

In accordance with another embodiment, the presently claimed programmable LED current PWM dimming controller includes the feature of over current protection (OCP), over voltage protection (OVP), over temperature protection (OTP), open and short circuit protection.

In accordance with another embodiment, the presently claimed programmable LED current PWM dimming controller includes the feature of LED thermal sensing with LED over temperature current compensation and shutdown.

BRIEF DESCRIPTION OF THE DRAWINGS

Embodiments of the invention are described in more detail hereinafter with reference to the drawings, in which.

DETAILED DESCRIPTION

In the following description, system and apparatus of programmable LED current PWM dimming controller and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
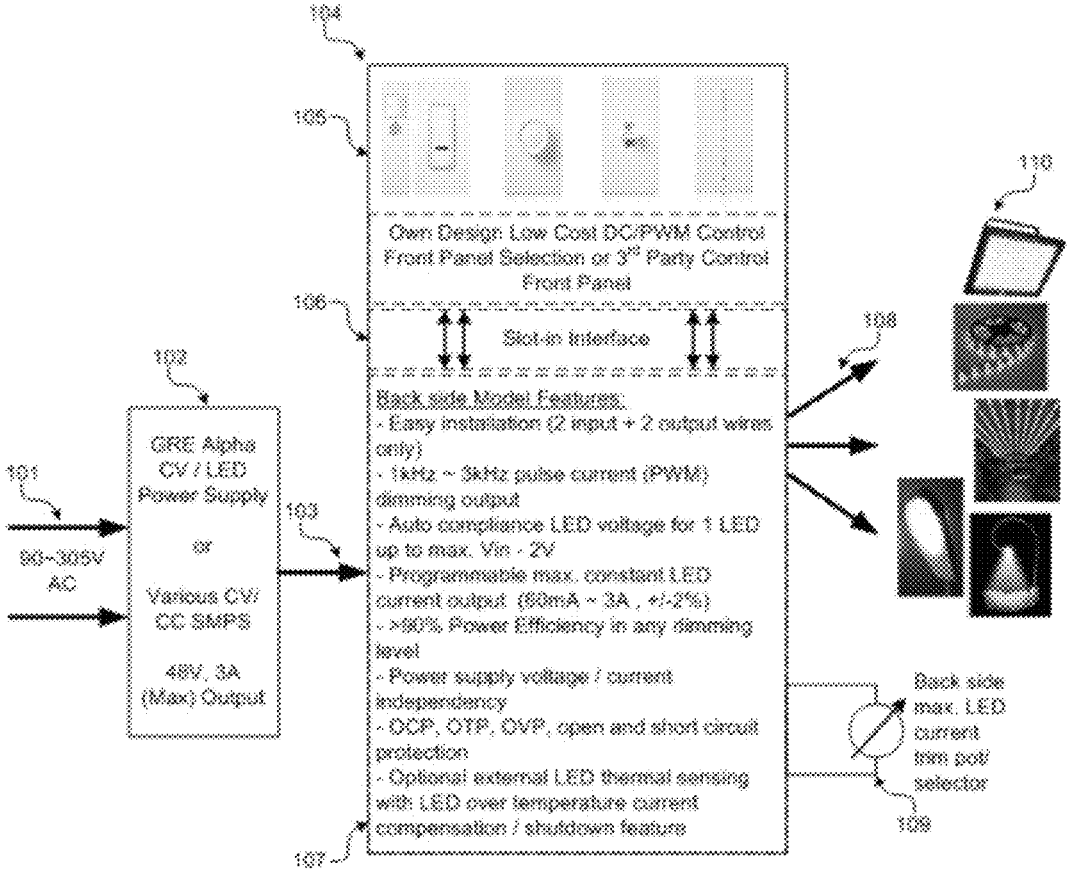
FIG. 1 shows a block diagram schematically illustrating a LED lighting system including an embodiment of a programmable LED current PWM dimming controller.

Referring to FIG. 1. In accordance with various embodiments the presently claimed programmable LED current PWM dimming controller 104 integrates a light dimming control front panel 105 with a PWM dimming module 107. The light dimming control front panel 105 can be one of the types of light dimming control panel including a mechanical-analog dial type control, a mechanical-analog slider type control, and an electronic-digital type control. The control front panel 105 can be own low cost design or a third party standard product. The control front panel 105 is attached to the backend PWM dimming module 107 via a slot-in interface 106. Because light dimming control front panel 105 is integrated with the PWM dimming module 107, only two pairs of electrical wires 103 and 108 are needed for the LED driver current input connection and LED feeding current output connection respectively.

In accordance with one embodiment, the PWM dimming module 107 features a low frequency 1 kHz to 3 kHz pulse current dimming output.

In accordance with another embodiment, the PWM dimming module 107 features an automatic compliance LED voltage feeding from one LED to a maximum number of LEDs where the aggregate voltage drop is within the range of $V_{in}$−2V, where $V_{in}$ is the feeding voltage to the one or more LEDs that are connected in series.

Still referring to FIG. 1. In accordance with one embodiment, the presently claimed programmable LED current PWM dimming controller includes a trim pot or selector 109 connected to a built-in constant current DC-DC buck converter for stepping down the maximum LED feeding current, such that different types of LEDs 110 can be driven by the same LED driver power supply 102; particularly in the case where the LED driver power supply is supplying a constant DC current that is higher than LEDs' rated maximum input current. For example, when coupled with a LED driver power supply that is rated at maximum output current of 3 A, the available maximum constant current supplying the LED can be from 60 mA to 3 A.

In accordance with another embodiment, the PWM dimming module 106 also includes circuitries for over-current protection (OCP), over-temperature protection (OTP), over-voltage protection (OVP), open circuit and short circuit protection. Optionally, the PWM dimming module 107 can include external LED thermal sensing circuitry with LED over-temperature current compensation and shutdown functions.

Figure 2:
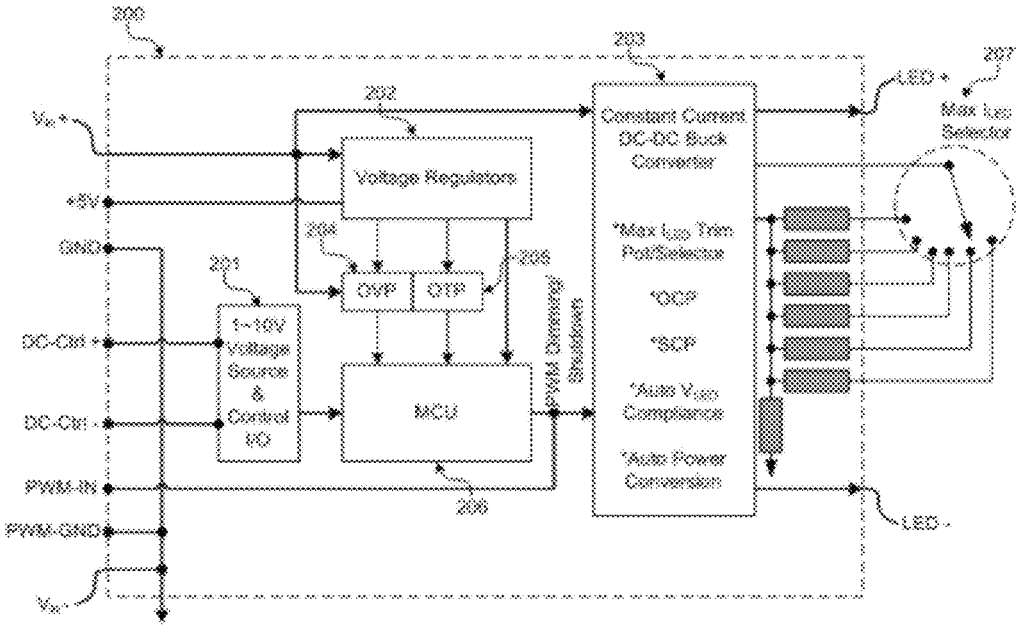
FIG. 2 shows a block diagram schematically illustrating an embodiment of a programmable LED current PWM dimming module.

Referring to FIG. 2. In accordance with one embodiment, the PWM dimming module includes a 1~10V voltage source and control input/output module 201 for receiving input signal from an analog type light dimming control front panel and providing a control signal for the processing unit 206 for controlling the pulse width modulation signal characteristic. The PWM dimming module also includes a voltage regulator 202 for maintaining a constant voltage level on the input voltage $V_{in}$ from the LED driver power supply; an over-voltage protection module 204; and an over-temperature protection module 205. The input voltage $V_{in}$, along with the PWM signal are fed into the constant current DC-DC buck converter 203 for any current step down as programmed. The current step down is programmed through a trim pot or selector 207.

Figure 3:
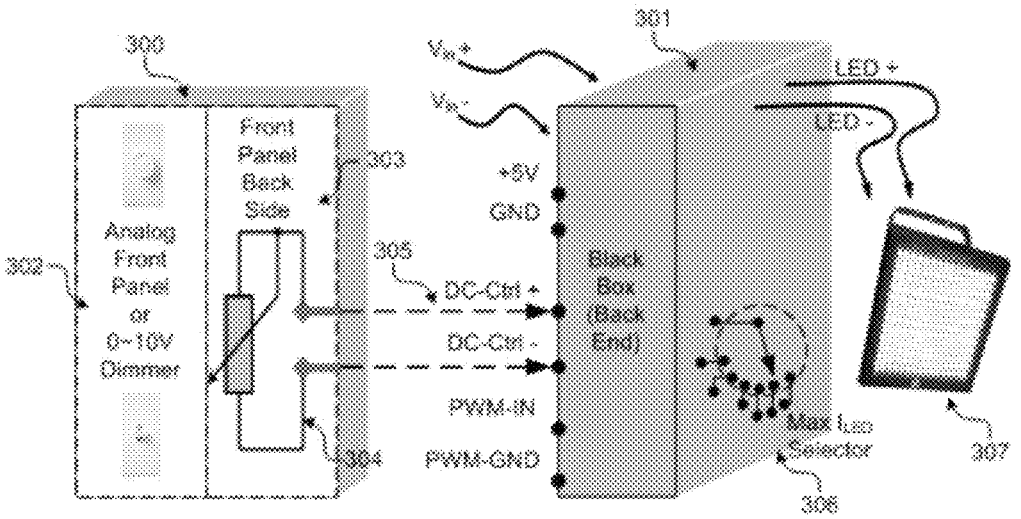
FIG. 3 shows a block diagram schematically illustrating the wiring configuration between the programmable LED current PWM dimming module and a mechanical-analog control front panel.

Referring to FIG. 3. In accordance with one embodiment, analog type light dimming control front panel 300 is connected to the PWM dimming module 301. Both components are integrated as a single unit, where the light dimming control front panel 300 is at the front and the PWM dimming module 301 is at the back as a black box. The analog type light dimming control front panel 300 provides analog control signal via DC-Ctrl+ and DC-Ctrl− wire connection to the MCU of the PWM dimming module.

Figure 4:
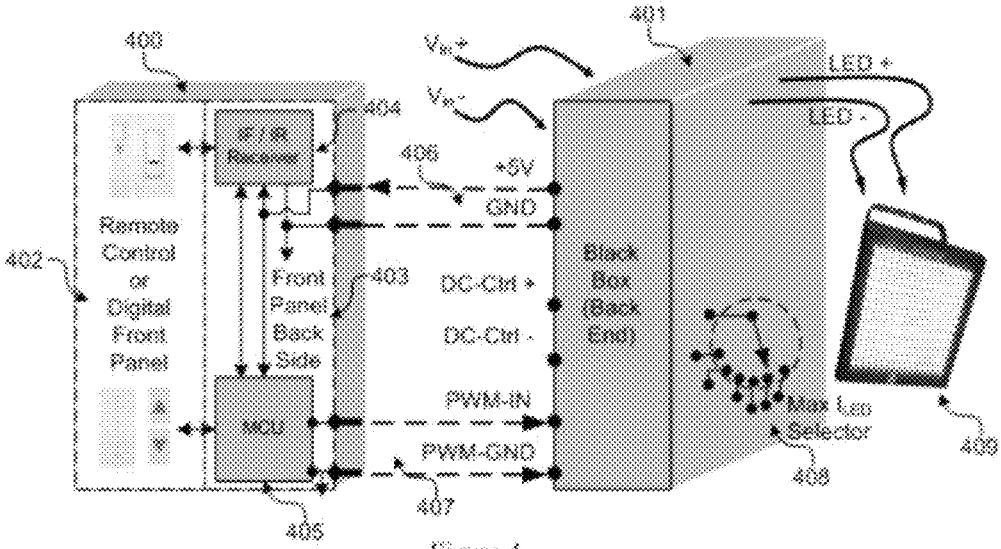
FIG. 4 shows a block diagram schematically illustrating the wiring configuration between the programmable LED current PWM dimming module and a electronic-digital control front panel.
Figure 5:
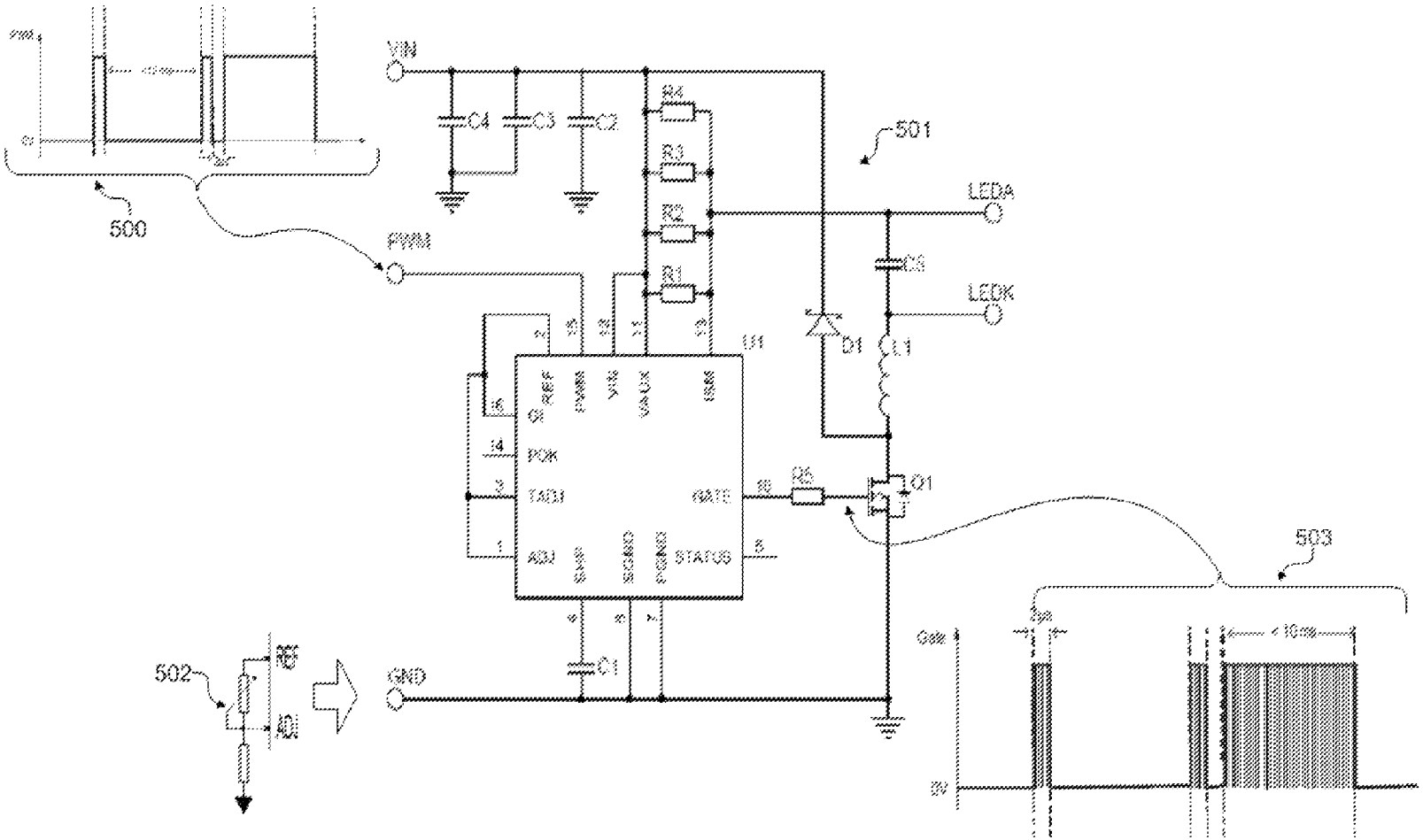
FIG. 5 illustrates schematically the circuitry of an embodiment of a programmable LED current PWM dimming module.

Referring to FIG. 4. In accordance with one embodiment, digital type light dimming control front panel 400 is connected to the PWM dimming module 401. The digital type light dimming control front panel 400 can also include an IF/IR Receiver 404 for remote control functionality. The digital type light dimming control front panel 400 includes a MCU 405 for generating PWM signal for dimming the LEDs.

In accordance with one embodiment, the electrical specification of the PWM dimming module is as follows:

Input Voltage ($V_{in}$) Range:
  12~48V ($V_{in}$>LED $V_f$+2V)
Output Voltage (LED $V_f$) Range:
  2.7~48V (Auto Compliance up to LED $V_f$)
Adjustable Max. LED Current:
  150 mA~3 A (selectable by trim pot/selector)
Power Efficiency:
  Typically 85% and up to 95%
LED Current Regulation:
  +/−1%
PWM Dimming Frequency:
  1 kHz (Analog dimming)
  100~3 kHz (PWM dimming)
Dimming Ratio:
  1:256 (@ 0~10V, DC-Ctrl+/− input)
  1:1000 (@ <1 kHz, PWM input)
  1:500 (@ >1 kHz~3 kHz PWM input)
+5V Output Current:
  100 mA (+/− 10%)
DC-Ctrl +/− Input Current:
  0V @ 0% LED Current
  +10V @ 100% LED Current
PWM-IN Input Voltage:
  2~5V (high level)
  0~0.4V (low level)

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. An integrated system for supplying direct current and brightness dimming for light emitting diodes (LEDs) comprising:

an LED driver power supply for supplying a constant direct current;

an array of one or more LEDs; and an integrated programmable LED current pulse width modulation (PWM) dimming controller comprising:

a front control panel for controlling the brightness of the array of one or more LEDs; and an LED current PWM dimming module;

wherein the front control panel is secured to the LED current PWM dimming module by a slot-in interface on the LED current PWM dimming module; and wherein the LED current PWM dimming module comprises:

an input voltage regulator;

an over current protection circuit;

an over temperature protection circuit;

a microcontroller for generating a pulse-width modulated current;

a direct current-to-direct current (DC-DC) buck converter for stepping down the pulse-width modulated current to establish a maximum LED-feeding current to said array of one or more LEDs; and a current selector, coupled to the DC-DC buck converter, for selecting amount of LED-feeding current step down in the DC-DC buck converter.

2. The integrated system of claim 1, wherein the front control panel can be a mechanical-analog type controller or an electronic-digital type controller.

3. The integrated system of claim 1, wherein the DC-DC buck converter includes:

an open circuit protection module;

a closed circuit protection module;

an automatic LED-feeding voltage compliance module; and an automatic power conversion module.

* * * * *